US005421569A

United States Patent [19]

Davidson

[11] Patent Number: 5,421,569

[45] Date of Patent: Jun. 6, 1995

[54] REPLACEABLE FEED/RETARD ROLL UNIT

[75] Inventor: Harry A. Davidson, Macedon, N.Y.

[73] Assignee: Xerox Corporation, Stamford, Conn.

[21] Appl. No.: 321,716

[22] Filed: Oct. 12, 1994

[51] Int. Cl.[6] ..... B65H 3/06; B65H 3/52

[52] U.S. Cl. ..... 271/109; 271/117; 271/122; 271/125; 271/274

[58] Field of Search ..... 271/109, 117, 121, 122, 271/124, 125, 273, 274

[56] References Cited

U.S. PATENT DOCUMENTS

| | | | |
|---|---|---|---|
| 5,039,080 | 8/1991 | Kato et al. | 271/122 |
| 5,172,899 | 12/1992 | Tajima | 271/125 X |
| 5,265,859 | 11/1993 | Watson et al. | 271/109 |

FOREIGN PATENT DOCUMENTS

| | | | |
|---|---|---|---|
| 148749 | 5/1992 | Japan | 271/273 |
| 256642 | 9/1992 | Japan | 271/273 |

*Primary Examiner*—David H. Bollinger
*Assistant Examiner*—Boris Milef
*Attorney, Agent, or Firm*—Kevin R. Kepner

[57] ABSTRACT

A replacement roller cartridge for a cut sheet retard feeder. The cartridge assembly includes a feed roll , a nudger roll, and a retard roll aligned so that the axis of rotation are substantially in the same plane within a frame. The frame is inserted into the feed head and pivoted into an active position. Upon insertion into the feed head, the retard roll is captured by a separate retard bracket so that when the feed head is pivoted into the active position the retard roll is withdrawn from the frame and forms a feed nip with the feed roll. A gear train is provided on both sides of the cartridge to drive the feed roll and the nudger roll. The cartridge assembly provides a low cost, easily replaceable unit that eliminates the need for a service technician to replace worn feed rolls. The design is also adaptable for use in various types of sheet and document feeders and can be used throughout a printing machine. The preassembled cartridge also obviates the need for a technician to calibrate or adjust the positions of the feed rolls as they are locked into position upon insertion and rotation of the cartridge frame into the feed head.

18 Claims, 4 Drawing Sheets

REPLACEABLE FEED/RETARD ROLL UNIT

This invention relates generally to a cut sheet feeder, and more particularly concerns a customer replaceable feed/retard roll CRU (customer replaceable unit) assembly for use in feeding cut sheets in an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

In printing machines such as those described above, semi-active retard paper feeders are used in document handlers, special material handlers, and in paper supply trays. As currently configured, the feed rollers, when worn, must be replaced by a service technician as a result of designs requiring disassembly of the feed head and replacement of several parts in several different areas in the feeder assembly. It is desirable to have a machine in which the feed head components, namely a nudger roller, a feed roller, a retard roll or pad, are easily replaceable by a customer. This easy replacement allows the customer to avoid a service technician call and also provides that the feed head components can be easily replaced by the customer when worn without down time.

It is also desirous to have a feed head replacement component that is low in cost and somewhat universal so as to be able to be used in different locations throughout the printing machine. It is further desirable to have a feed head replacement component which does not require extensive adjustment and/or disassembly of the printing machine for replacement.

The following disclosures may be relevant to various aspects of the present invention:

U.S. Pat. No. 5,265,859 Inventor: Watson et al. Issue Date: Nov. 30, 1993

The relevant portions of the foregoing disclosures may be briefly summarized as follows:

U.S. Pat. No. 5,265,859 describes a roller assembly having first and second rollers connected by a gear train. The driven roller is biased toward a drive connection and the entire assembly snap-fits into a feed head cover.

In accordance with one aspect of the present invention, there is provided an apparatus a unitary feed member apparatus for a feed head assembly for feeding cut sheets from a stack of sheets. The apparatus comprises a frame, a plurality of rotatable members mounted in the frame and a retard member removably mounted in the frame adjacent one of the plurality of rotatable members so that when the frame is inserted in the feed head assembly and moved from a first position to a second position, the retard member is released from the frame and forms a nip with the adjacent one of the plurality of rotatable members.

Pursuant to another aspect of the present invention, there is provided an electrophotographic printing machine having a sheet feeder having a unitary feed member cartridge for the feed head for feeding cut sheets from a stack of sheets. The cartridge comprises a frame, a plurality of rotatable members mounted in the frame and a retard member removably mounted in the frame adjacent one of the plurality of rotatable members so that when the frame is inserted in the feed head assembly and moved from a first position to a second position, the retard member is released from the frame and forms a nip with the adjacent one of the plurality of rotatable members Pursuant to yet another aspect of the present invention, there is provided a customer replaceable unit for a sheet feeder for feeding cut sheets from a stack of sheets. The customer replaceable unit comprises a frame, a plurality of rotatable members mounted in the frame and a retard member removably mounted in the frame adjacent one of the plurality of rotatable members so that when the frame is inserted in the feed head assembly and moved from a first position to a second position, the retard member is released from the frame and forms a nip with the adjacent one of the plurality of rotatable members.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 5:
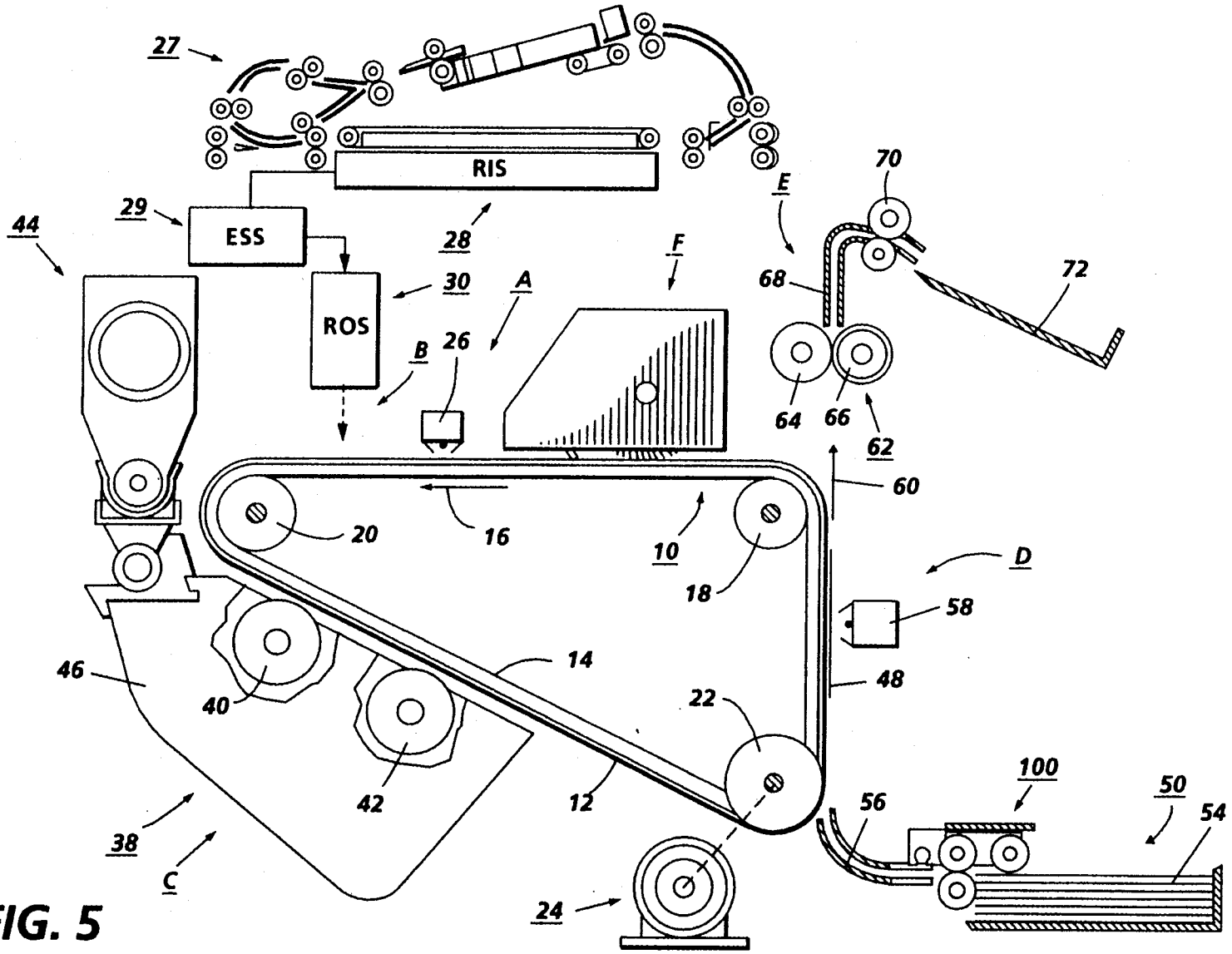
FIG. 5 is a schematic elevational view of a typical electrophotographic printing machine utilizing the feed/retard roll cartridge therein.

For a general understanding of the features of the present invention, reference is made to the drawings. In the drawings, like reference numerals have been used throughout to identify identical elements. FIG. 5 schematically depicts an electrophotographic printing machine incorporating the features of the present invention therein. It will become evident from the following discussion that the feed/retard roll cartridge assembly of the present invention may be employed in a wide variety of devices and is not specifically limited in its application to the particular embodiment depicted herein.

Referring to FIG. 5 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 5 schematically illustrates an electrophotographic printing machine which generally employs a belt 10 having a photoconductive surface 12 deposited on a conductive ground layer 14. Preferably, photoconductive surface 12 is made from a photoresponsive material, for example, one comprising a charge generation layer and a transport layer. Conductive layer 14 is made preferably from a thin metal layer or metallized polymer film which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges the photoconductive surface, 12, to a relatively high, substantially uniform potential. After photoconductive surface 12 of belt 10 is charged, the charged portion thereof is advanced through exposure station B.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 20 at a resolution of about 300 or more pixels per inch. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 20 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. Preferably, at development station C, a magnetic brush development system, indicated by reference numeral 38, advances developer material into contact with the latent image. Magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 5, after the electrostatic latent image is developed, the toner powder image present on belt 10 advances to transfer station D. A print sheet 48 is advanced to the transfer station, D, by a sheet feeding apparatus, 100. Preferably, sheet feeding apparatus 100 includes a feed roll 110 forming a retard nip with retard roll 114, and nudger roll 112 contacting the uppermost sheet of stack 54. The nudger 112 advances the topmost sheet through the retard nip and into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

The fusing station, E, includes a fuser assembly, indicated generally by the reference numeral 62, which permanently affixes the transferred powder image to sheet 48. Fuser assembly 60 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 68 through one or more drive roll idler roll assembly 70 to catch tray 72 for subsequent removal from the printing machine by the operator.

After the print sheet is separated from photoconductive surface 12 of belt 10, the residual toner/developer and paper fiber particles adhering to photoconductive surface 12 are removed therefrom at cleaning station F. Cleaning station F includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 1:
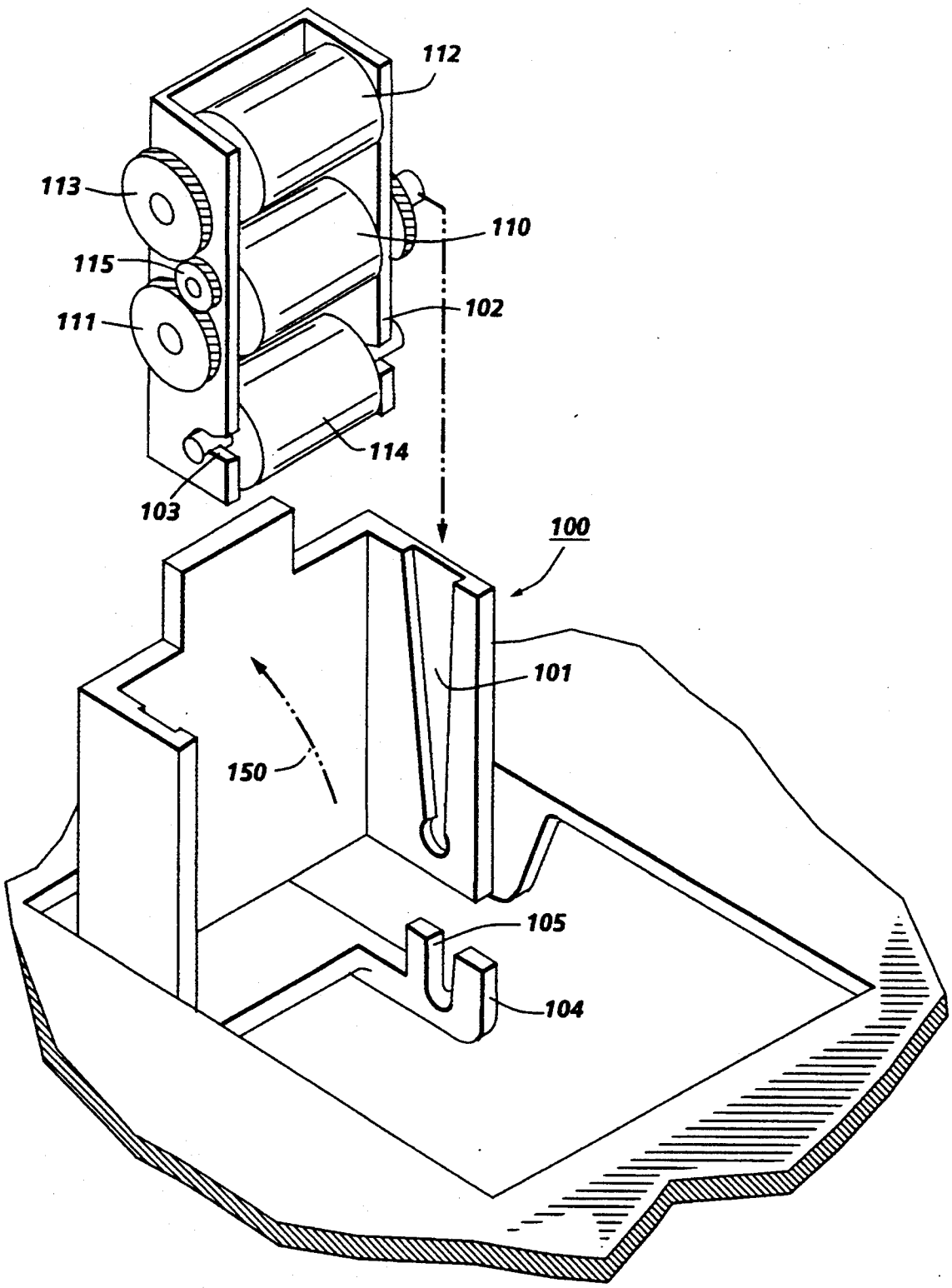
FIG. 1 is a perspective view of the cartridge of the present invention prior to insertion into the feedhead.
Figure 2:
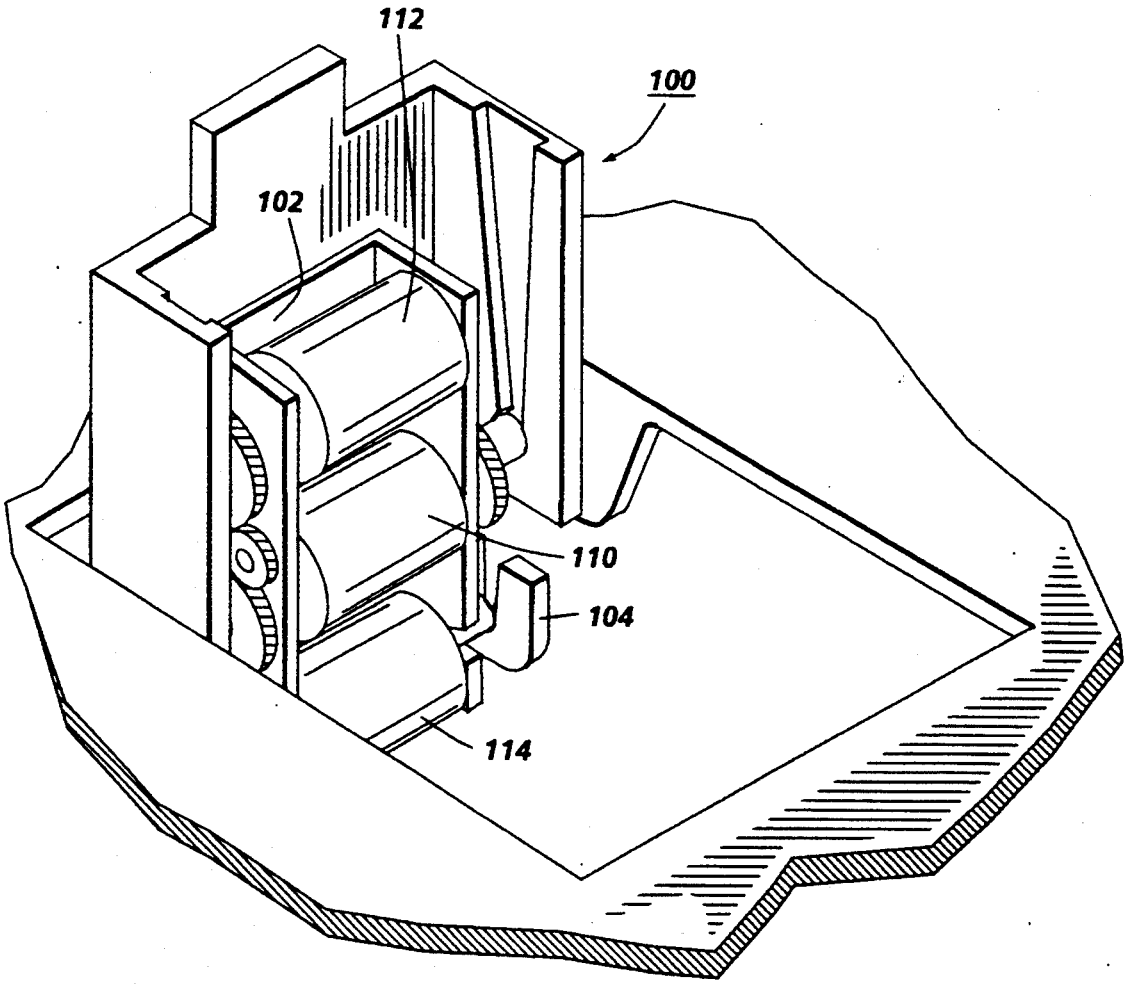
FIG. 2 is a perspective view of the cartridge of the present invention after insertion into the feedhead.

Turning now to FIGS. 1 and 2, there is illustrated a perspective view of the feed head assembly of the present invention. In FIG. 1, the feeder frame 100 is illustrated as pivoted in the replacement position in the direction of arrow 150 to receive the feed roll/retard roll replacement cartridge. The replacement cartridge is made of a frame 102, a feed roll 110, a nudger roll 112, a retard roll 114, and a gear train 111, 113 and 115, to drive both the feed roll and the nudger roll. It can be seen that the retard roll 114 is supported in notches 103 in the frame 102 by stub axles.

The entire feed roll assembly cartridge is inserted in a vertical position into slots 101 in the feed head frame 100. Located directly below the slots is the retard roll bracket 104, also having a notch 105 for supporting the retard roll stub axles.

Turning next to FIG. 2, the feed roll cartridge is shown inserted into the feed head frame 100 and still pivoted in the vertical direction. It can be seen in FIG. 2 that the retard roll 114 is supported both in the cartridge frame 102 and in the retard roll bracket 104. The frame is secured into the feedhead by a detent which snap fits the feed roll axle in position. This snap fit detent also provides the center point for pivoting the feedhead into the active position as described below.

Figure 3:
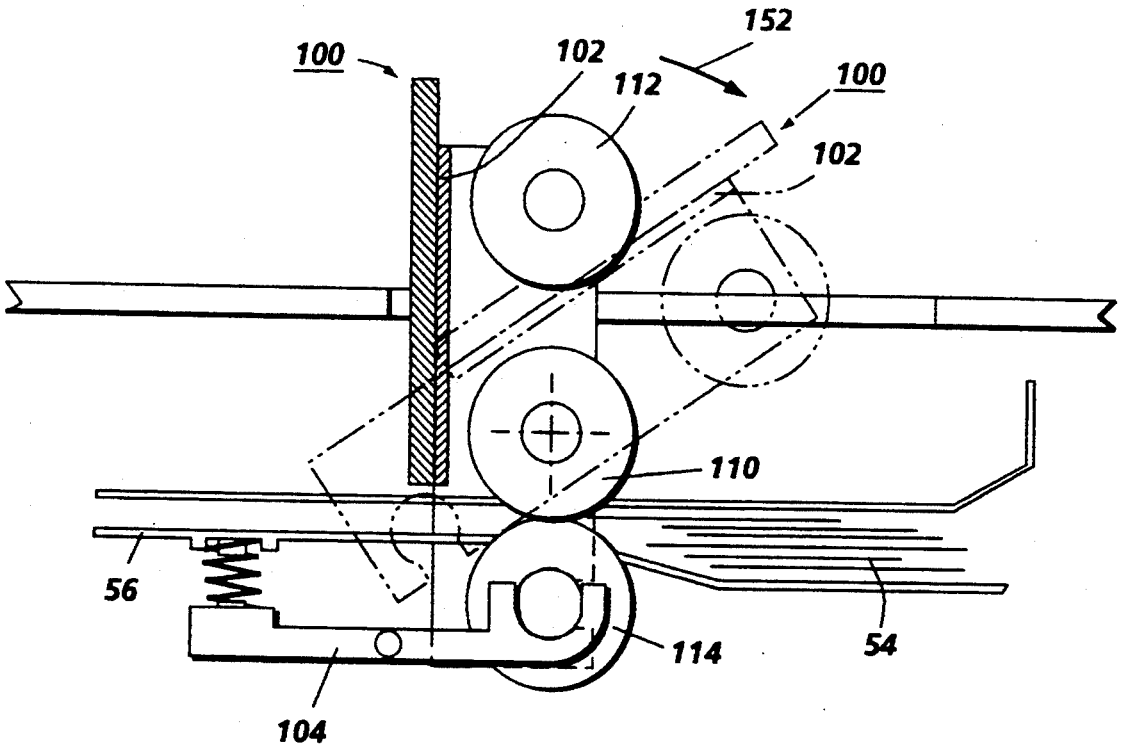
FIG. 3 is a side elevational view of FIG. 2.
Figure 4:
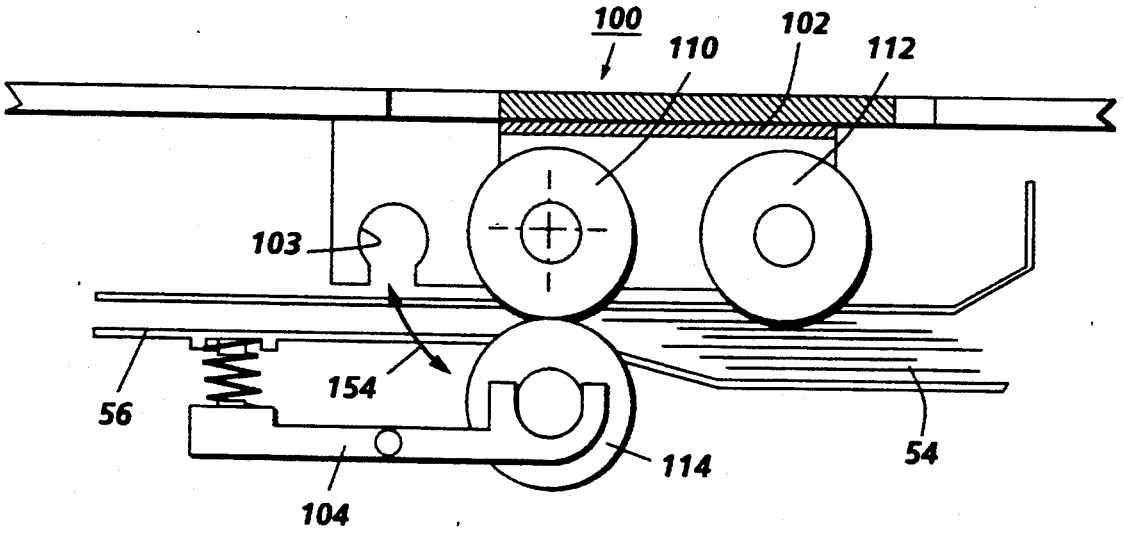
FIG. 4 is an elevational view illustrating the pivoting of the cartridge into the operational position.

Turning next to FIGS. 3 and 4, the feed head is shown being rotated into the active position. The entire feed head assembly 100 is rotated in the direction of arrow 152 to bring the feed roll 110 and nudger roll 112 into the active position. The entire feed head rotates about the axle of the feed roll 110. As the feed head 100 is rotated into the horizontal position, it can be seen (FIG. 4) that the retard roll 114 disengages from the notch 103 in the feed cartridge frame 102. As the notch is rotated about the feed roll 110 in the direction of arrow 154, it is seen that the retard roll 114 is now fully supported in the retard roll bracket 104. The retard roll may be of the type having an internal reversing torque spring clutch mechanism or it may have a coupler or gear to attach the retard shaft to a reverse driving motor (not shown). The nudger roll 112 contacts the uppermost sheet of the sheet stack 54 and when the feed roll and nudger roll are activated through the gear train causes the topmost sheet of the stack 54 to be fed into the nip between the feed roll 110 and the retard roll 114. This nudger roll/feed roll/.retard roll assembly operates in the same manner as a standard retard roll feeder.

In operation the nudger roll 112 contacts the topmost sheet on the stack and advances the sheet to the nip formed by the feed roll 110 and retard roll 114. When a single sheet enters the nip the friction force between the feed roll 110, the sheet and the retard roll 114 is great enough to overcome and reverse driving force applied to the retard roll 114 by anyone one of several known methods. These methods include actively drive retard rolls utilizing one-way or slip clutches and also spring storage devices and clutches to provide reversing torque. When more than one sheet is forwarded to the nip the frictional force between the sheets is not great enough to overcome the reverse torque on the retard roll and the sheet is driven back toward the sheet stack.

The gear train 111, 113, 115, is provided on both sides of the cartridge frame 102 so as to be adaptable to many different utilizations within the printing machine and to be able to be driven from either side of the feed head assembly. To remove a worn set of feed rollers, the above procedure is reversed. The feed head frame 100 is pivoted up into the vertical position opposite the direction of arrow 152 (FIG. 3). As the framework 102 of the cartridge assembly is rotated into the vertical position, the notch 103 in the framework 102 captures the stub axles of retard roll 114. The entire feed cartridge assembly which now includes again the retard roll 114 is then lifted out of the feed head frame 100 and replaced.

Thus, it can be seen that the feed head cartridge assembly provides for a simple and economical way to replace worn feed rolls and/or retard rolls in a feed head assembly. The simplicity and ease of replacement allows a customer to replace the feed roll assembly without the need to call in or contact a service technician and face the possibility of a delay as a result thereof.

It is also apparent from the drawings herein that the retard roll could be replaced by a retard pad assembly which would be supported in much the same manner as the retard roll and allow for a replacement of a retard pad feed roll/nudger roll assembly in the same manner. Likewise, a feeder belt assembly or a feed roll/non-round nudger member could be substituted for the feed roll/nudger roll and be replaced in the same manner as described above.

The assembly as shown is adaptable to various locations throughout an electrophotographic printing machine or any other type printing machine in which individual cut sheets are fed from the top of a sheet stack. Due to this versatility, the same feed roll design can be located in several locations, thereby reducing the spare part inventory required for a particular machine or machines. The simplicity of the device further allows for user replacement without the need for factory service calls.

In recapitulation, there is provided a replacement roller cartridge for a cut sheet retard feeder. The cartridge assembly includes a feed roll, a nudger roll, and a retard roll aligned so that the axis of rotation are substantially in the same plane within a frame. The frame is inserted into the feed head and pivoted into an active position. Upon insertion into the feed head, the retard roll is captured by a separate retard bracket so that when the feed head is pivoted into the active position the retard roll is withdrawn from the frame and forms a feed nip with the feed roll. A gear train is provided on both sides of the cartridge to drive the feed roll and the nudger roll. The cartridge assembly provides a low cost, easily replaceable unit that eliminates the need for a service technician to replace worn feed rolls. The design is also adaptable for use in various types of sheet and document feeders and can be used throughout a printing machine. The preassembled cartridge also obviates the need for a technician to calibrate or adjust the positions of the feed rolls as they are locked into position upon insertion and rotation of the cartridge frame into the feed head.

It is, therefore, apparent that there has been provided in accordance with the present invention, a customer replaceable feed roll assembly that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A unitary feed member apparatus for a feed head assembly for feeding cut sheets from a stack of sheets, comprising:

a frame;

a plurality of rotatable members mounted in said frame; and a retard member removably mounted in said frame adjacent one of said plurality of rotatable members so that when said frame is inserted in the feed head assembly and moved from a first position to a second position, said retard member is released from said frame and forms a nip with said adjacent one of said plurality of rotatable members.

2. An apparatus according to claim 1, wherein said rotatable members comprise a first roll and a second roll, each of said rolls mounted rotatably in said frame.

3. An apparatus according to claim 2, wherein said retard member comprises:

a bracket mounted in said frame; and a retard roll supported in said bracket.

4. An apparatus according to claim 3, wherein:

said first roll forms the nip with said retard roll; and said second roll contacts an outermost sheet of the stack and forwards the outermost sheet to the nip.

5. An apparatus according to claim 1, wherein said frame defines a notch for supporting said retard member, so that upon pivoting said frame from the first position to the second position, said retard member is released from said frame.

6. An apparatus according to claim 5, wherein upon pivoting of said frame from the second position to the first position, said retard member is captured in the notch in said frame.

7. An electrophotographic printing machine having a sheet feeder having a unitary feed member cartridge for the feed head for feeding cut sheets from a stack of sheets, comprising:

a frame;

a plurality of rotatable members mounted in said frame;

a retard member removably mounted in said frame adjacent one of said plurality of rotatable members so that when said frame is inserted in the feed head assembly and moved from a first position to a second position, said retard member is released from said frame and forms a nip with said adjacent one of said plurality of rotatable members.

8. A printing machine according to claim 7, wherein said rotatable members comprise a first roll and a second roll, each of said rolls mounted rotatably in said frame.

9. A printing machine according to claim 8, wherein said retard member comprises:

a bracket mounted in said frame; and a retard roll supported in said bracket.

10. A printing machine according to claim 9, wherein:

said first roll forms the nip with said retard roll; and said second roll contacts an outermost sheet of the stack and forwards the outermost sheet to the nip.

11. A printing machine according to claim 7, wherein said frame defines a notch for supporting said retard member, so that upon pivoting said frame from the first position to the second position, said retard member is released from said frame.

12. A printing machine according to claim 11, wherein upon pivoting of said frame from the second position to the first position, said retard member is captured in the notch in said frame.

13. A customer replaceable unit for a sheet feeder for feeding cut sheets from a stack of sheets, comprising:

a frame;

a plurality of rotatable members mounted in said frame; and a retard member removably mounted in said frame adjacent one of said plurality of rotatable members so that when said frame is inserted in the feed head assembly and moved from a first position to a second position, said retard member is released from said frame and forms a nip with said adjacent one of said plurality of rotatable members.

14. A customer replaceable unit according to claim 13, wherein said rotatable members comprise a first roll and a second roll, each of said rolls mounted rotatably in said frame.

15. A customer replaceable unit according to claim 14, wherein said retard member comprises:

a bracket mounted in said frame; and a retard roll supported in said bracket.

16. A customer replaceable unit according to claim 15, wherein:

said first roll forms the nip with said retard roll; and said second roll contacts an outermost sheet of the stack and forwards the outermost sheet to the nip.

17. A customer replaceable unit according to claim 13, wherein said frame defines a notch for supporting said retard member, so that upon pivoting said frame from the first position to the second position, said retard member is released from said frame.

18. A customer replaceable unit according to claim 17, wherein upon pivoting of said frame from the second position to the first position, said retard member is captured in the notch in said frame.

* * * * *